US007225544B2

(12) United States Patent
Petzl

(10) Patent No.: US 7,225,544 B2
(45) Date of Patent: Jun. 5, 2007

(54) ICE AXE FOR MOUNTAINEERING WITH ADJUSTABLE GRIP

(75) Inventor: Paul Petzl, Barraux (FR)

(73) Assignee: Zedel, Crolles (FR)

( * ) Notice: Subject to any disclaimer, the term of this patent is extended or adjusted under 35 U.S.C. 154(b) by 2 days.

(21) Appl. No.: 10/962,678

(22) Filed: Oct. 13, 2004

(65) Prior Publication Data

US 2005/0108881 A1 May 26, 2005

(30) Foreign Application Priority Data

Nov. 24, 2003 (FR) ..... 03 13721

(51) Int. Cl.
*B26B 23/00* (2006.01)
*B25F 1/00* (2006.01)

(52) U.S. Cl. ..... 30/381; 30/308.2; 30/312; 30/340; 71/145; 71/161; 81/20; 8/14; 8/76

(58) Field of Classification Search ..... 30/308.1, 30/340, 308.2, 308.3, 312, 342; 7/161, 167, 7/145, 143, 116, 162; 81/20; D8/75, 77, D8/78–81, 76, 14; 403/187, DIG. 3, DIG. 9; 248/216.1, 217; 16/111.1, 421; 15/410, 15/144.1; 132/66

See application file for complete search history.

(56) References Cited

U.S. PATENT DOCUMENTS 1,431,389 A * 10/1922 Frisz ..... 81/177.7
2,028,561 A * 1/1936 Pilger ..... 81/177.9
3,879,048 A * 4/1975 Penney ..... 280/821
3,992,021 A * 11/1976 Tobin ..... 280/821
4,023,606 A * 5/1977 Kneissl ..... 30/308.1
4,308,628 A * 1/1982 Kunberger et al. ..... 7/145
D266,903 S * 11/1982 Tarran ..... D8/76
4,402,529 A 9/1983 Cavazza
4,850,079 A * 7/1989 Thompson ..... 16/421
5,261,164 A * 11/1993 Bellegante ..... 30/308.1
5,771,588 A * 6/1998 Petrich ..... 30/308.2
5,862,723 A * 1/1999 Rowlands ..... 81/177.9
5,937,466 A * 8/1999 Brainerd et al. ..... 7/145
5,943,925 A * 8/1999 Huang ..... 81/177.2
5,996,235 A * 12/1999 Brainerd ..... 30/308.1
6,009,600 A * 1/2000 Egeland et al. ..... 16/436

(Continued)

FOREIGN PATENT DOCUMENTS

DE 34 42 933 A1 6/1986

(Continued)

*Primary Examiner*—Boyer D. Ashley
*Assistant Examiner*—Ghassem Alie
(74) *Attorney, Agent, or Firm*—Oliff & Berridge, PLC

(57) ABSTRACT

The ice axe for mountaineering includes a head, a shaft, and an anatomical grip having one free end and an end secured to the shaft. The grip defines a handling zone of the ice axe and includes an adjusting member for adjusting the length of the handling zone. The adjustment member includes an adjustment end-piece arranged at the free end of the grip. The handling zone is bounded by the adjustment end-piece and by a protuberance of the grip at its end secured to the shaft. The adjustment end-piece is mounted on and pivoted around a rotation pin. The free end of the grip includes a plurality of notches operating in conjunction with a plurality of grooves of the adjustment end-piece and corresponding to different positions of the adjustment end-piece.

5 Claims, 6 Drawing Sheets

U.S. PATENT DOCUMENTS

D448,639 S * 10/2001 Petzl ..... D8/76
6,357,067 B1 * 3/2002 Jones ..... 7/116
6,382,058 B1 * 5/2002 Owoc ..... 81/177.9
6,543,824 B2 * 4/2003 Beaudrie ..... 294/24
6,944,955 B2 * 9/2005 Skrivan et al. ..... 30/308.1

FOREIGN PATENT DOCUMENTS

FR A 2709971 3/1995

* cited by examiner

ICE AXE FOR MOUNTAINEERING WITH ADJUSTABLE GRIP

BACKGROUND OF THE INVENTION

The invention relates to an ice axe for mountaineering comprising a head, a shaft, and an anatomical grip having one free end and an end secured to the shaft, and defining a handling zone of the ice axe of length L bounded by an adjustment end-piece arranged at the free end of the grip, and by a protuberance of the grip at its end secured to the shaft, the grip comprising adjustment means for adjusting the length L of the handling zone.

STATE OF THE ART

Ice axes used by mountaineers are safety tools for climbing ice or very hard snow slopes. An ice axe generally comprises a head acting as support for an adze or a hammer and for an anchoring spike, and a hollow shaft wherein the head is hafted. The anchoring spike in the form of an elongate blade is designed to penetrate into the ice to ensure efficient anchorage allowing a traction to be exerted on the shaft. The spike and adze are generally interchangeable elements with different shapes and sizes for the mountaineer to have at his disposal the ice axe best suited to the terrain. How the shaft is held in the mountaineer's hand constitutes an essential efficiency factor for penetration of the spike into the ice. The mountaineer generally holds the end of the shaft so as to have the highest striking torque appropriate for optimum penetration force of the spike into the ice. It is imperative that at the moment the impact with the ice takes place, the mountaineer doesn't let go of the shaft.

For this purpose, an ice axe has already been proposed equipped with an anatomical grip, i.e. a grip following the shape of the hand. The document FR-A-2,709,971 describes an anatomical grip formed on the shaft opposite the head of the ice axe. The grip generally has a profile corresponding to the average grip of a mountaineer. However, handling of the grip is not always efficient as the size of the mountaineer's hand may vary depending on whether he is wearing thin or thick gloves, or whether he is not wearing any gloves at all. Likewise, the ice axe can not be adapted according to the gripping morphology of the mountaineer. Also, handling is not necessarily the same depending on the use envisaged (ice slopes or very hard snow slopes). However, a poorly adapted grip reduces the efficiency of striking and increases the risks of falling.

Grips with a telescopic adjustment end-piece have also been proposed. The adjustment end-piece slides inside the grip to obtain a more or less long handling length. However, when the adjustment end-piece is set to the maximum handling length, the space thus created has to be filled by fitting washers of a set diameter between the adjustment end-piece and the grip. Adjustment is therefore fastidious, requires additional parts to be removed or added, and handling is not always totally satisfactory.

OBJECT OF THE INVENTION

The object of the invention is to overcome these drawbacks and to achieve an ice axe for mountaineering having an adjustment end-piece, the handling whereof is improved, according to the gripping morphology of the climber and the use envisaged.

According to the invention, this object is achieved by the fact that the adjustment end-piece is mounted pivoting on the grip.

According to a preferred embodiment of the invention, the adjustment end-piece is mounted rotating around a pin perpendicular to the longitudinal axis of the grip.

According to one feature of the invention, the grip comprises a plurality of holes corresponding to different positions of the adjustment end-piece, the ice axe comprising a locking part designed to be inserted in one of the holes and to secure the adjustment end-piece in one of said positions.

According to another feature of the invention, the free end of the grip comprises a plurality of notches corresponding to different positions of the adjustment end-piece, the adjustment end-piece comprising a plurality of grooves operating in conjunction with the notches of the free end so as to secure the adjustment end-piece in one of said positions.

BRIEF DESCRIPTION OF THE DRAWINGS

Other advantages and features will become more clearly apparent from the following description of particular embodiments of the invention, given as non-restrictive examples only and represented in the accompanying drawings, in which.

DESCRIPTION OF THE PREFERRED EMBODIMENT

Figure 1:
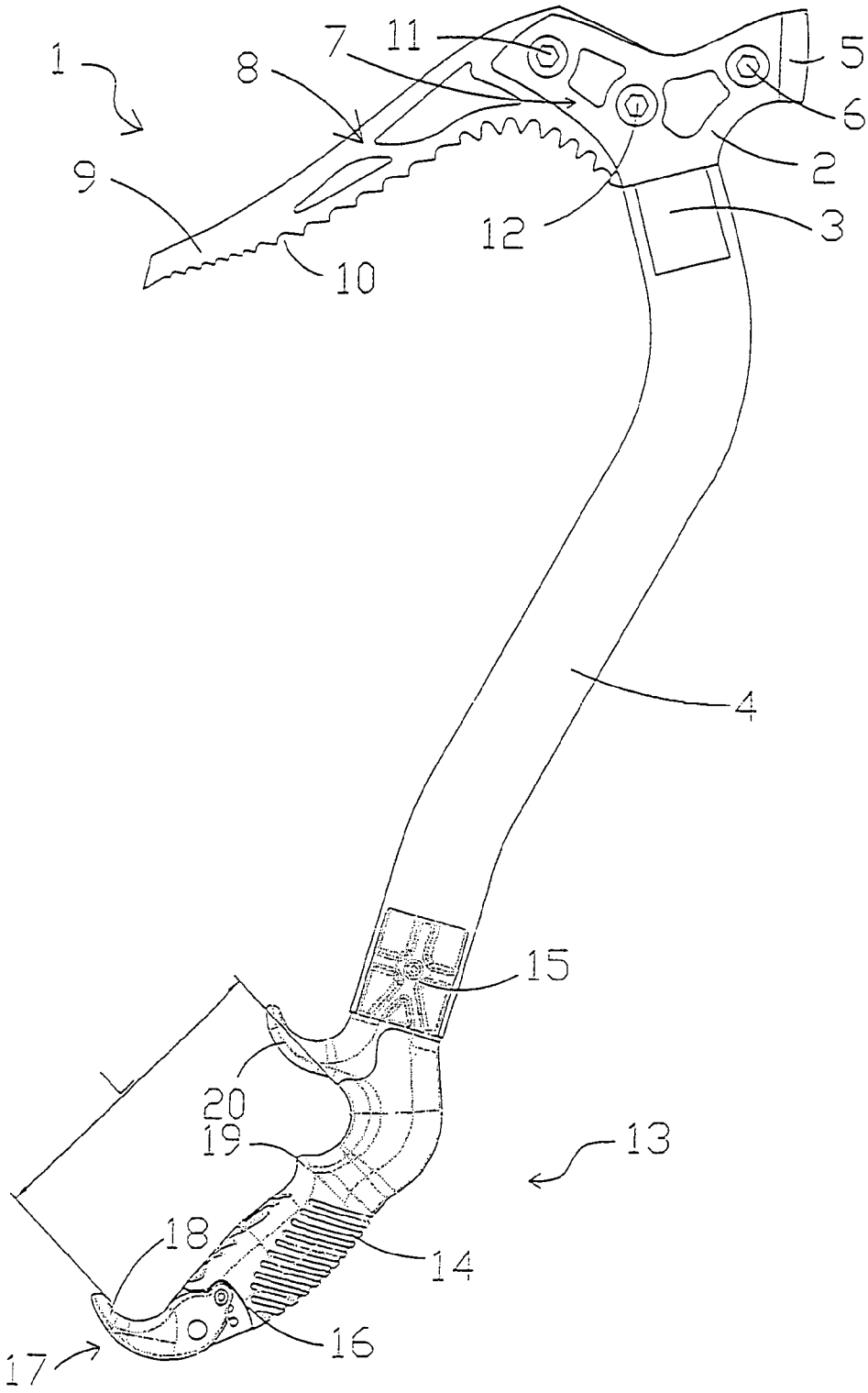
FIG. 1 is a partial cross-sectional view of the ice axe according to the invention.

In FIG. 1, an ice axe 1 for mountaineering is comprised of a head 2 equipped with a fixing end-piece 3 hafted in a shaft 4, preferably in the form of a hollow tube. The cross-section of the end-piece 3 is non circular, for example oval or elliptic, so as to ensure that the head 2 cannot rotate in the shaft 4.

A first end 5 of the head 2 bears a striking hammer fixed in unremovable manner by a screw 6. It is possible to replace the hammer by an adze (not shown).

A second end 7 of the head 2, opposite the end 5, acts as support for a spike 8 formed by an interchangeable metal blade. The spike 8 is preferably made of high mechanical strength steel and comprises a blade 9 equipped along the bottom edge with a series of gripping teeth 10 enabling an optimum anchorage effect of the spike 8 in ice or hard snow to be obtained. Fixing of the spike 8 on the head 2 is performed by assembly means with screws 11 and 12.

The length of the shaft 4 depends on the size of the climber, and the shape of the shaft 4 is curved so as to be better suited to the terrain. The bottom end of the shaft 4 is equipped with a grip 13 having an anatomical shape. The grip 13 is made of a synthetic or elastomer-based plastic material and is added by molding from casting onto a skeleton 14, of flat cross-section, preferably made of aluminium alloy. The grip 13 comprises a fixing end 15 hafted in the shaft 14 and a free end 16.

The grip 13 also comprises adjustment means 17 to adjust the size of the grip 13 to the size of the climber's hand. The adjustment means 17 comprise a pivoting adjustment end-piece 18. A handling zone 19 is bounded by the grip 13. The handling zone 19, of length L, is situated between the adjustment end-piece 18 and a protuberance 20 of the grip 13 at the level of the fixing end 15 fixedly secured to the shaft 4. Preferably, the adjustment end-piece 18 and protuberance 20 are salient outwards from the grip 13 and are shaped as hooks, advantageously oriented in the direction of the head 2 of the ice axe 1. These hooks give the climber an additional possibility of grasping the grip 13.

Figure 2:
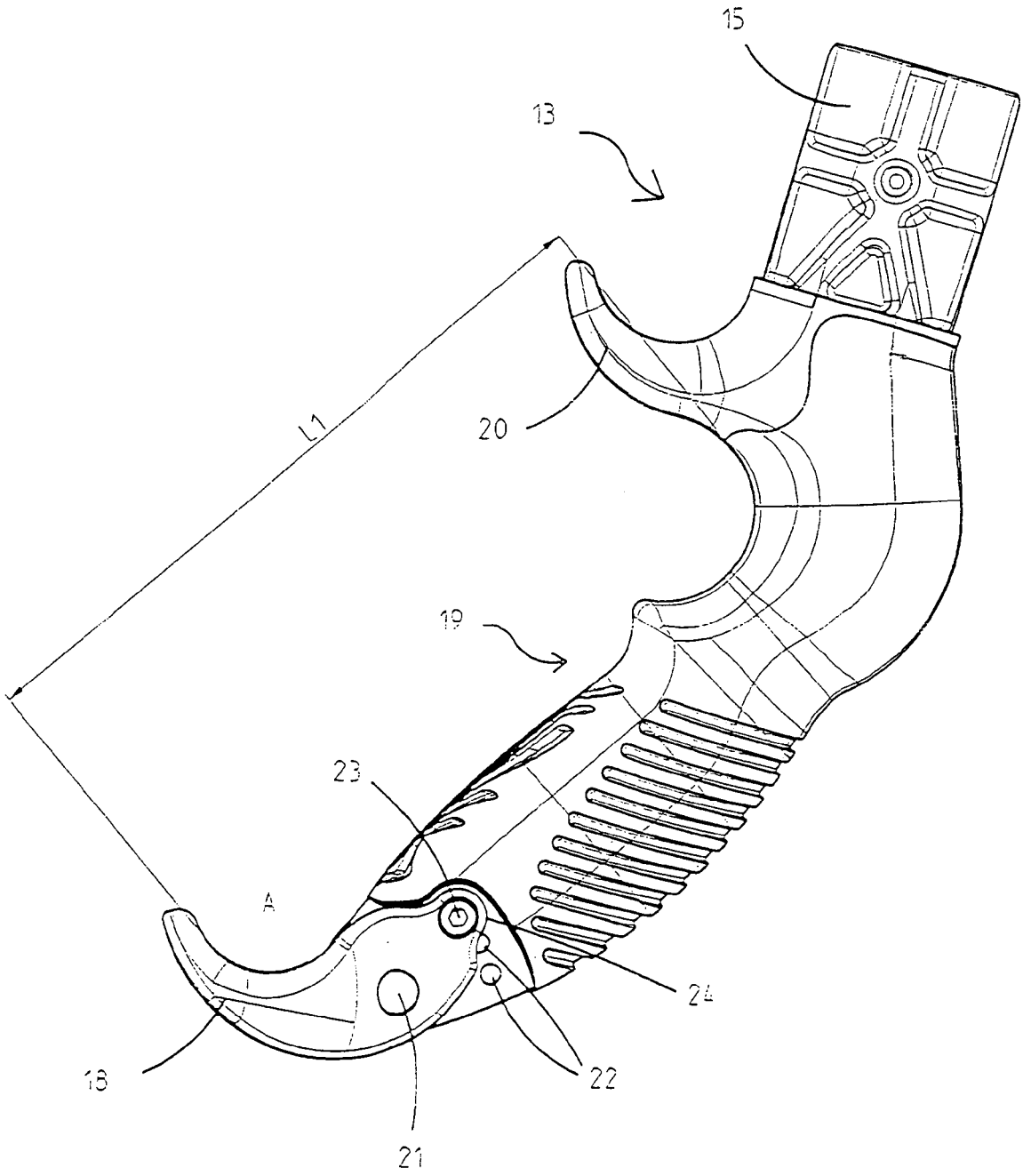
FIGS. 2 and 3 are side views of the grip according to the invention, respectively in a first end of travel position A and in a second end of travel position B.
Figure 3:
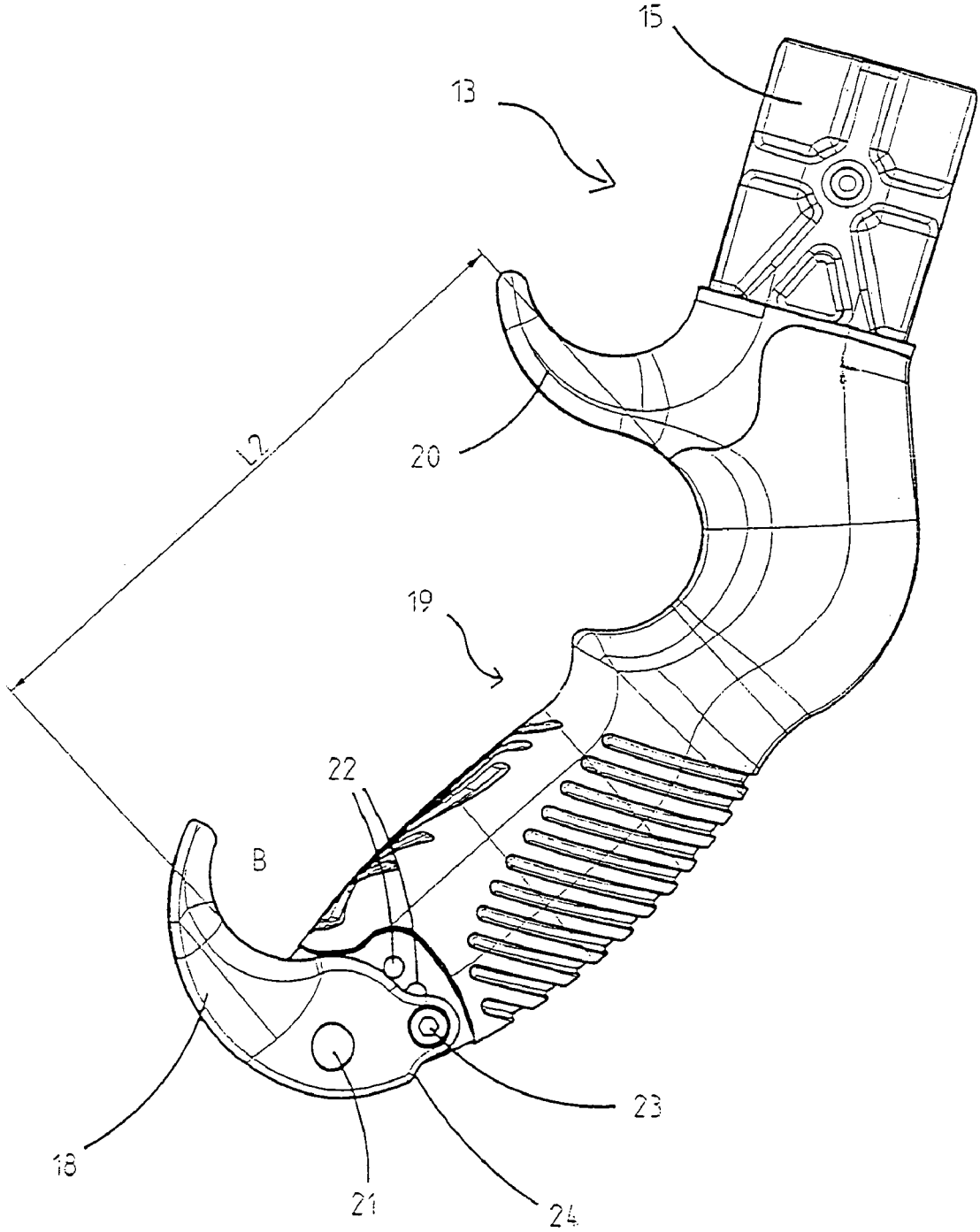

In FIGS. 2 and 3, the adjustment end-piece 18 is mounted free in rotation, in the adjustment phase only, around a pin 21 perpendicular to the longitudinal axis of the grip 13. The grip 13 comprises a plurality of holes 22 arranged transversely and corresponding to different positions that the adjustment end-piece 18 can take. The ice axe 1 also-comprises a locking member 23 designed to be inserted in one of the holes and to secure the adjustment end-piece 18 in a position decided on by the climber. For this purpose, the adjustment end-piece 18 comprises a tongue 24 with a hole of similar diameter to that of the holes 22 of the grip 13. The locking member 23 is then inserted when the two holes are facing one another. The locking member 23 is advantageously a nut and bolt system, enabling an efficient type of locking of the adjustment end-piece 18 on the grip 13 to be achieved. Any other type of locking can naturally be used.

Adjustment of the length L of the handling zone 19 is performed before the ice axe 1 is used, and the adjustment end-piece 18, after locking, remains immobile and fixedly secured to the grip 13 during use by the climber. Position A, representing the first end of travel position of the adjustment end-piece 18 is obtained when the tongue 24 of the adjustment end-piece 18 is positioned on one of the holes 22, located closest to the handling zone 19. In this position, the locking member 23 performs final locking of the two parts 13 and 18 by inserting a bolt through the two holes and tightening the assembly with a nut. A first length L1 of the handling zone 19 is thus obtained. The design of the grip 13 and of the adjustment end-piece 18 preferably gives a length L1 of about 114 mm (FIG. 2).

Position B, which is the second end of travel position opposite to position A, is obtained after the locking member 23 has been untightened and the adjustment end-piece 18 has been rotated around its pin 21. The hole of the tongue 24 then comes to face the hole 22 of the grip located farthest from the handling zone 19. Final locking of the two parts 13 and 18 is performed in the same way as for position A, by means of the locking member 23. The second length L2 of the handling zone 19 is thus obtained. The length L2 is preferably about 92.1 mm (FIG. 3).

The head 2, and the shaft 4 and skeleton 14 of the grip 13, are advantageously made of aluminium alloy. Molding from casting of the plastic material of the grip 13 takes account of the average hand size of a climber, for example about 90 mm.

The ice axe 1 is well suited to all gripping morphologies and to all types of use, as the presence of the adjustment means 17 enables optimum handling of the ice axe 1.

The adjustment means 17 are not limited to the embodiment described above. Particularly, the grip 13 can for example comprise additional adjustment means enabling the rotation pin of the adjustment end-piece 18 to be moved. Notably, an oblong hole can be made in the grip 13 or in the adjustment end-piece 18. The rotation pin 21 of the adjustment end-piece 18 can thus take several positions to optimize handling by the climber. The locking member 23 remains for example a nut and bolt system, or any other locking means.

Figure 4:
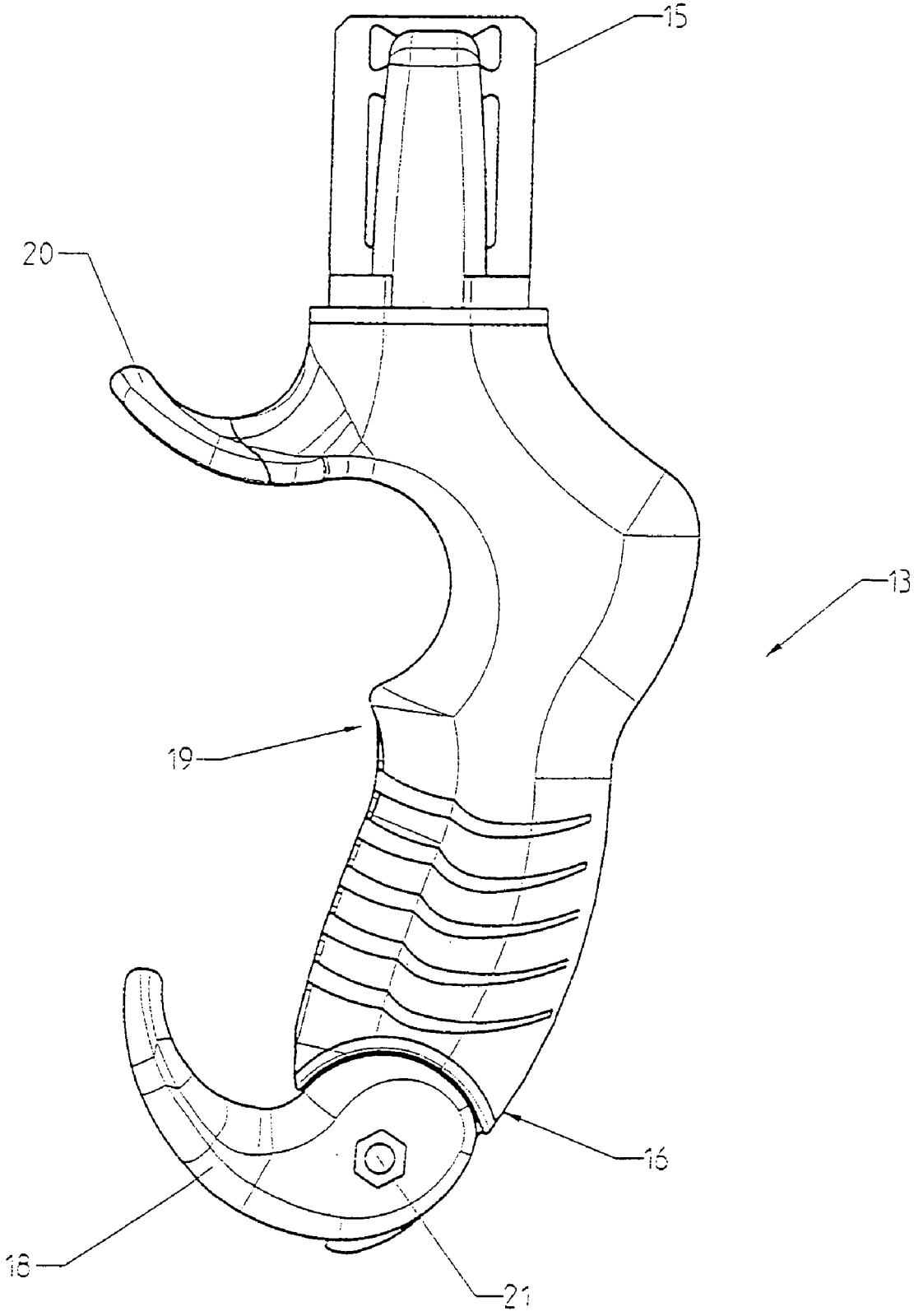
FIG. 4 is a side view of an alternative embodiment of the grip according to the invention.
Figure 5:
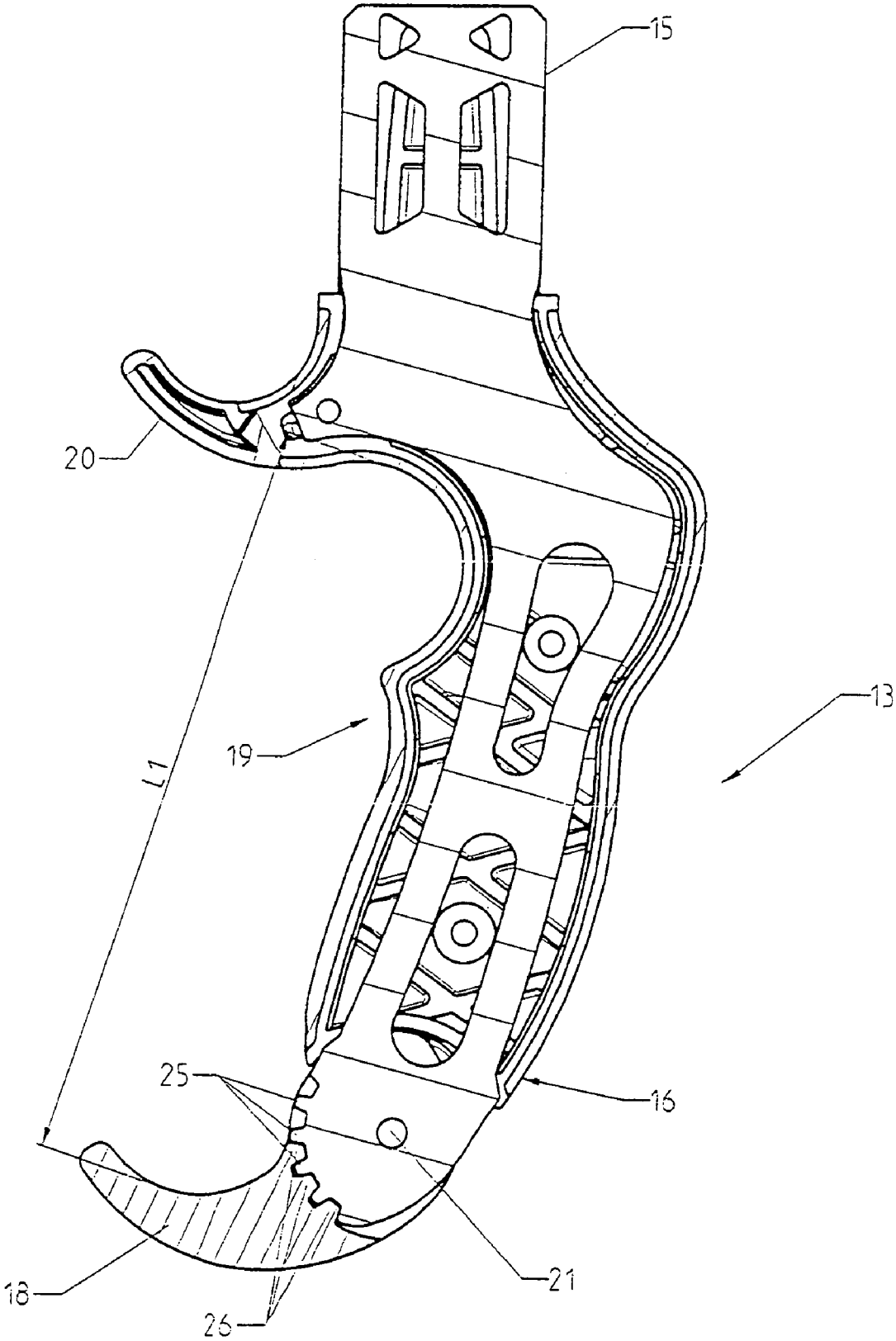
FIGS. 5 and 6 are cross-sectional views of the grip according to FIG. 4, respectively in the first end of travel position A and in the second end of travel position B.
Figure 6:
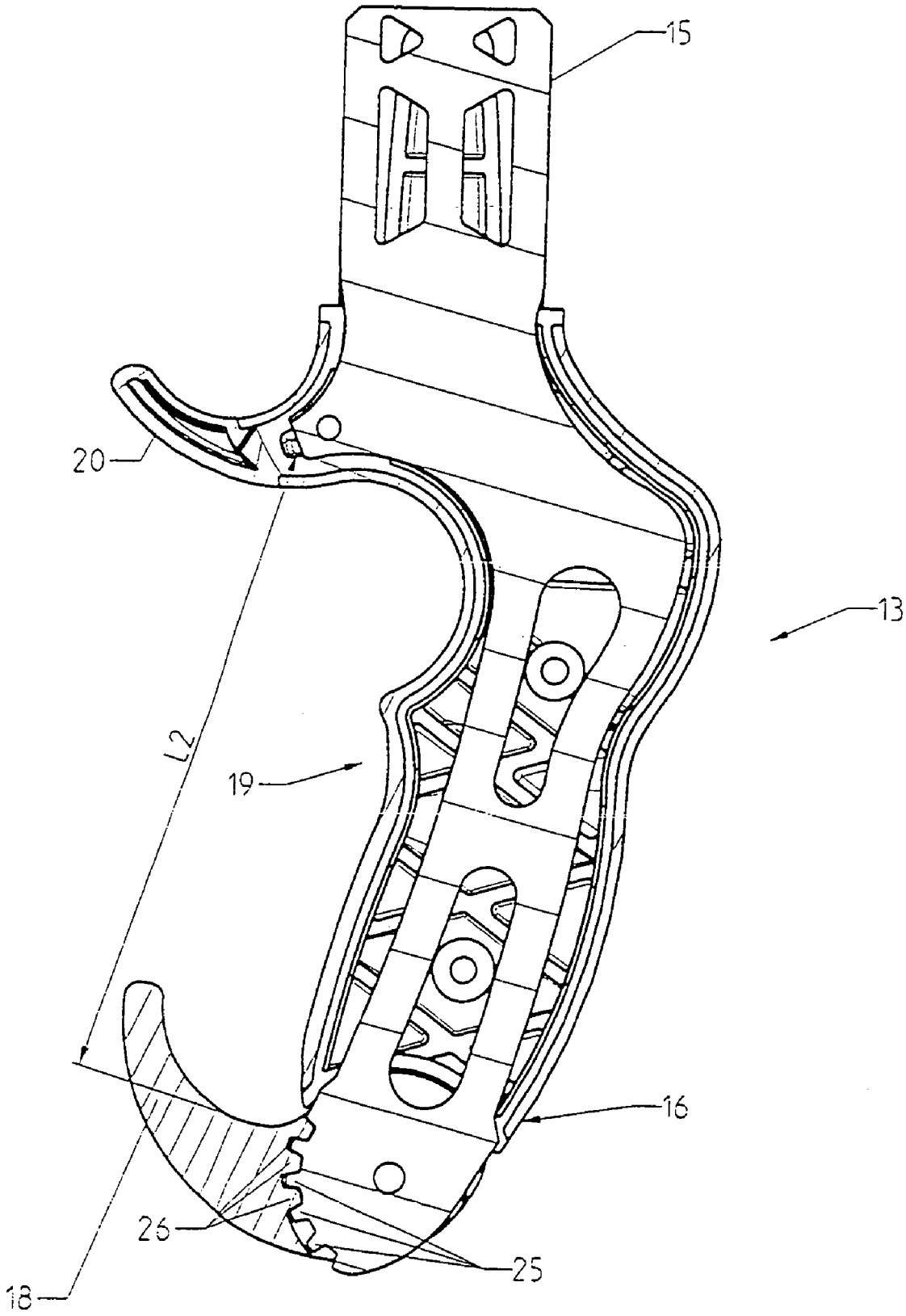

In an alternative embodiment represented in FIGS. 4 to 6, the grip 13 is distinguished from the previous embodiment by the adjustment means 17. The adjustment end-piece 18 is mounted freely rotating, in the adjustment phase only, around the rotation pin 21. The free end 16 of the grip 13 comprises a plurality of notches 25 corresponding to the different positions that the adjustment end-piece 18 can take. The adjustment end-piece 18 comprises a plurality of grooves 26 operating in conjunction with the notches 25 of the free end 16 to place the adjustment end-piece 18 in a preset position. The position of the notches 25 and grooves 26 can naturally be reversed.

Position A (FIG. 5), representing the first end of travel position of the adjustment end-piece 18, is obtained, after the rotation pin 21 has been untightened, when the grooves 26 of the adjustment end-piece 18 are positioned at the level of the notches 25 of the free end 16 that are located the farthest from the hafted end 15. The notches 25 of the free end 16 closest to the hafted end 15 are then not used. In this position, the rotation pin 21 performs final locking of the two parts 13 and 18 by means for example of a nut. The first length L1 corresponding to the maximum length of the handling zone 19 is thus obtained.

Position B (FIG. 6), which is the second end of travel position opposite position A, is obtained, after the rotation pin 21 has been untightened, the adjustment end-piece 18 has been rotated around the pin 21 and the grooves 26 of the adjustment end-piece 18 have been positioned facing the notches 25 of the free end 16 of the grip 13. In this position, the grooves 26 of the adjustment end-piece 18 are positioned in the notches 25 of the free end 16 closest to the hafted end 15. The notches 25 of the free end 16 farthest from the hafted end 15 are then not used. Final locking of the two parts 13 and 18 is performed in the same way as for position A by means of the rotation pin 21. The second length L2 corresponding to the minimum length of the handling zone 19 is thus obtained.

The invention claimed is:

1. Ice axe device for mountaineering, comprising:

a head equipped with a spike and a fixing end-piece, a shaft having an upper end for receiving said fixing end-piece and a bottom end, and an anatomical grip having a first intermediate end secured to said bottom end of the shaft, and a second opposite end defining a longitudinal handling zone arranged between a protuberance located near the first intermediate end, and an adjustable end-piece mounted on and pivoting around a pin of the second end for adjusting the length of said handling zone, wherein said pivotable end-piece and said protuberance protrude outward from the grip.

2. Ice axe according to claim 1, wherein the pin of said adjustable end-piece is perpendicular to the longitudinal axis of the grip.

3. Ice axe according to claim 2, wherein said end-piece comprises an oblong hole to secure the pin in different positions.

4. Ice axe according to claim 1, wherein the second end of the grip comprises a plurality of holes corresponding to different positions of the adjustable end-piece, a locking member being inserted into one of the holes to secure said end-piece in one of said positions.

5. Ice axe according to claim 1, wherein the second end of the grip comprises a plurality of notches cooperating with corresponding grooves of the adjustable end-piece for adjusting said end-piece in o a predetermined position.

* * * * *